US009335130B2

(12) United States Patent
Unterlack

(10) Patent No.: US 9,335,130 B2
(45) Date of Patent: May 10, 2016

(54) KUNG FU FAN TASER WEAPON

(71) Applicant: Robert Louis Unterlack, Wimauma, FL (US)

(72) Inventor: Robert Louis Unterlack, Wimauma, FL (US)

( * ) Notice: Subject to any disclaimer, the term of this patent is extended or adjusted under 35 U.S.C. 154(b) by 40 days.

(21) Appl. No.: 13/600,257

(22) Filed: Oct. 25, 2012

(65) Prior Publication Data

US 2013/0229745 A1 Sep. 5, 2013

(51) Int. Cl.

| | |
|---|---|
| ***H01T 23/00*** | (2006.01) |
| ***F41H 13/00*** | (2006.01) |
| ***H05C 1/00*** | (2006.01) |
| ***F41B 15/04*** | (2006.01) |

(52) U.S. Cl.

CPC ..... *F41H 13/0018* (2013.01); *F41B 15/04* (2013.01); *H05C 1/00* (2013.01)

(58) Field of Classification Search

USPC ..... 361/232

See application file for complete search history.

(56) References Cited

U.S. PATENT DOCUMENTS

| | | | | |
|---|---|---|---|---|
| 7,872,849 | B2 * | 1/2011 | Elliott, Jr. | 361/232 |
| 7,878,424 | B2 * | 2/2011 | Schnuckle | 239/289 |
| 8,021,281 | B2 * | 9/2011 | Forsell et al. | 482/84 |

* cited by examiner

*Primary Examiner* — Stephen W Jackson

(57) ABSTRACT

The Kung Fu Fan stunner is a weapon for Non-lethal personal self-defense purposes. It can be used by average men and women for personal security as a stunner device, a striking implement, and a Kung Fu Fan. When the fan is open in a locked position indicated by a snap on the blue button, the red button on the fan can be pressed to deliver an electrical shock. The electrical current that can strike and stun and individual fires along the fans perimeter edge when the fan is in a locked open position and the red button is pressed. The device can also have an optional Solar Panel Inlay in The Fans Fabric so the Fan can charge its own battery continuously via solar rays. Defensive possibilities increase for Martial Artists trained in the use of the Kung Fu Fans Classical Techniques.

2 Claims, 1 Drawing Sheet

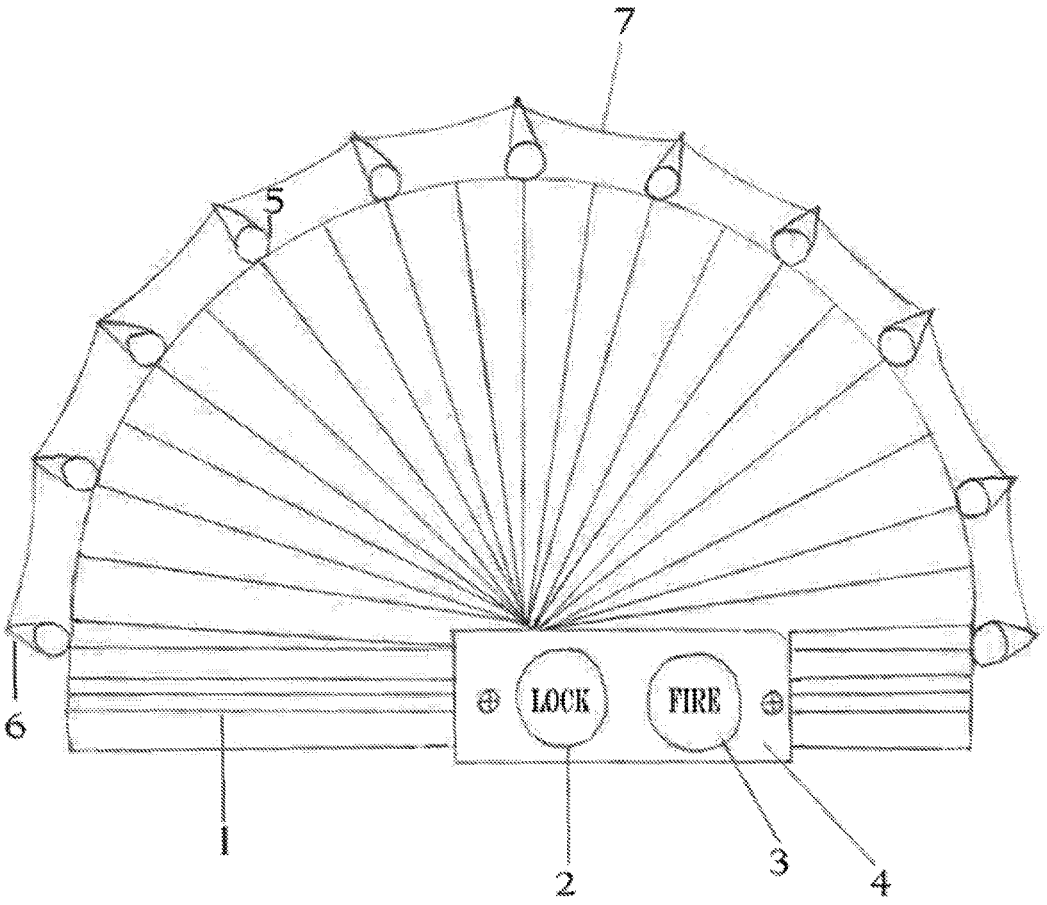
7
5
6
LOCK
FIRE
1
2
3
4

KUNG FU FAN TASER WEAPON

BACKGROUND OF THE INVENTION

This invention is a handheld stunner device that makes use of a high, non-lethal voltage that is applied to a human or animal attacker as a defensive measure. Such devices are powered by a rechargeable battery that powers a voltage boosting circuit that increases the voltage at the output of the stunner device to levels effective to impede or disable the above mentioned attacker.

BRIEF SUMMARY OF THE INVENTION

This Kung Fu stunner Fan is a self-defense non-lethal weapon device for personal protection against street thugs and criminals. This Utility Invention is a modification of the Classical Chinese Kung Fu Fan.

DETAILED DESCRIPTION OF THE DRAWING

FIG. 1 shows wires extending out from a battery back along the base of the Fan. element 4 shows the battery pack which is screwed onto the base of the fighting fan. element 2 and 3 shows two buttons that exist on the energy pack. In element two, when the fan is open all the way to its widest point, the fan snaps into place and the lock button, element two, pops into place. element 3 shows the fire button. Once the fan is open and locks into place, you are able to press the fire button to release the stunner charge. When the fire button, element three, is pressed, the electricity fires out along the sheathed wires from the energy pack. The sheathed wires or element 1, are connected to a metal coil around a ball bearing in element 5. In element 6, the metal barbed hook extends through a hole in the metal ball bearing and attaches to the sheathed wires along the fans base. The Ball Bearing, element 5, receives the charge and transfers the charge to a coil copper wire that extends all the way around the fans perimeter in element 7. The spring loaded coiled copper wire, element 7, is laced along the fans perimeter inside a small barbed hook that is hooked through a small hole in the metal ball bearings center. When the fan is in the unlocked open position, the spring loaded coil copper wire helps the fan back into the closed position. The Charge is delivered in a chain like reaction along the coil copper wire across the entire perimeter of the fan when the fan is opened locked and the battery is charged and the fire is button pressed.

DETAILED DESCRIPTION OF THE INVENTION

The stunner device contains conventional voltage boosting circuits of the type known in the art and can also be used with any other combination of elements that can increase voltage to effective levels. A remarkable aspect of the invention is the use of solar cell elements as part of the fans folded material, such that thru conventional connection of the cells to the stunner battery system, recharging powered by the sun or other light source may be effected.

The invention claimed is:

1. A hand held stunner device comprising:

A housing structure configured to operate as a martial arts fighting fan of the type having a closed arrangement having a folded sheet material and having an open arrangement with said sheet material unfolded in a semi-circular shape, with said housing structure having a rechargeable power supply and controllable electrical circuit to deliver a stunning voltage to an outer edge of the semicircular shape of the fighting fan.

2. The stunner device of claim 1, further including the use of solar cell type elements in the semicircular shape of the fan, with said elements having connection to the power supply for the purpose of recharging.

* * * * *

UNITED STATES PATENT AND TRADEMARK OFFICE

CERTIFICATE OF CORRECTION

PATENT NO. : 9,335,130 B2
APPLICATION NO. : 13/600257
DATED : May 10, 2016
INVENTOR(S) : Robert Louis Unterlack It is certified that error appears in the above-identified patent and that said Letters Patent is hereby corrected as shown below:

Title Page, Item (54) and in the Specification at Column 1, line 1, title should be changed to --Kung Fu Fan Stunner Weapon--. Cancel the title "Kung Fu Fan Taser Weapon".

Signed and Sealed this
Seventh Day of June, 2016

Michelle K. Lee

Michelle K. Lee
*Director of the United States Patent and Trademark Office*